US010239734B2

(12) United States Patent
Mastebroek

(10) Patent No.: US 10,239,734 B2
(45) Date of Patent: Mar. 26, 2019

(54) METHOD FOR LOWERING A SUBSEA STRUCTURE HAVING A SUBSTANTIALLY FLAT SUPPORT BASE INTO THE WATER THROUGH THE SPLASH ZONE

(71) Applicant: BLUEMARINE OFFSHORE YARD SERVICE B.V., Rotterdam (NL)

(72) Inventor: Klaas Wout Mastebroek, Pijnacker (NL)

(73) Assignee: BLUEMARINE OFFSHORE YARD SERVICE B.V., Rotterdam (NL)

( * ) Notice: Subject to any disclaimer, the term of this patent is extended or adjusted under 35 U.S.C. 154(b) by 0 days.

(21) Appl. No.: 15/129,999

(22) PCT Filed: Mar. 30, 2015

(86) PCT No.: PCT/NL2015/050201
§ 371 (c)(1),
(2) Date: Sep. 28, 2016

(87) PCT Pub. No.: WO2015/147647
PCT Pub. Date: Oct. 1, 2015

(65) Prior Publication Data

US 2017/0174480 A1 Jun. 22, 2017

(30) Foreign Application Priority Data

Mar. 28, 2014 (NL) ..... 2012527

(51) Int. Cl.
*B63B 27/16* (2006.01)
*B66C 1/66* (2006.01)
(Continued)

(52) U.S. Cl.
CPC ..... *B66C 23/52* (2013.01); *B63B 27/10* (2013.01); *E02D 29/06* (2013.01)

(58) Field of Classification Search
CPC . B65G 5/00; F17C 1/007; F17C 3/005; F17C 2203/00; F17C 2203/0604;
(Continued)

(56) References Cited

U.S. PATENT DOCUMENTS 5,069,580 A * 12/1991 Herwig ..... B63C 11/34 405/188
5,232,257 A * 8/1993 Koide ..... B66C 1/66 294/68.27
(Continued)

FOREIGN PATENT DOCUMENTS

DE 1174198 B * 7/1964 ..... B63B 27/10
DE 1174198 B 7/1964
(Continued)

OTHER PUBLICATIONS

"International Application No. PCT/NL2015/050201, International Preliminary Report on Patentability dated Nov. 7, 2016", (dated Nov. 7, 2016), 17 pgs.
(Continued)

*Primary Examiner* — Benjamin F Fiorello
*Assistant Examiner* — Edwin J Toledo-Duran
(74) *Attorney, Agent, or Firm* — Schwegman Lundberg & Woessner, P.A.

(57) ABSTRACT

The present invention relates to a method for lowering a subsea structure to be installed on the seabed into the water through the splash zone, said subsea structure comprising subsea equipment arranged on a substantially flat support base for preventing the subsea equipment to sink into the seabed. The method according to the invention comprises: lifting the subsea structure into the air in a horizontal position in which the flat support base extends substantially parallel to the horizontal plane; tilting the subsea structure while suspended in the air from the horizontal position into
(Continued)

Figures 1, 1A:
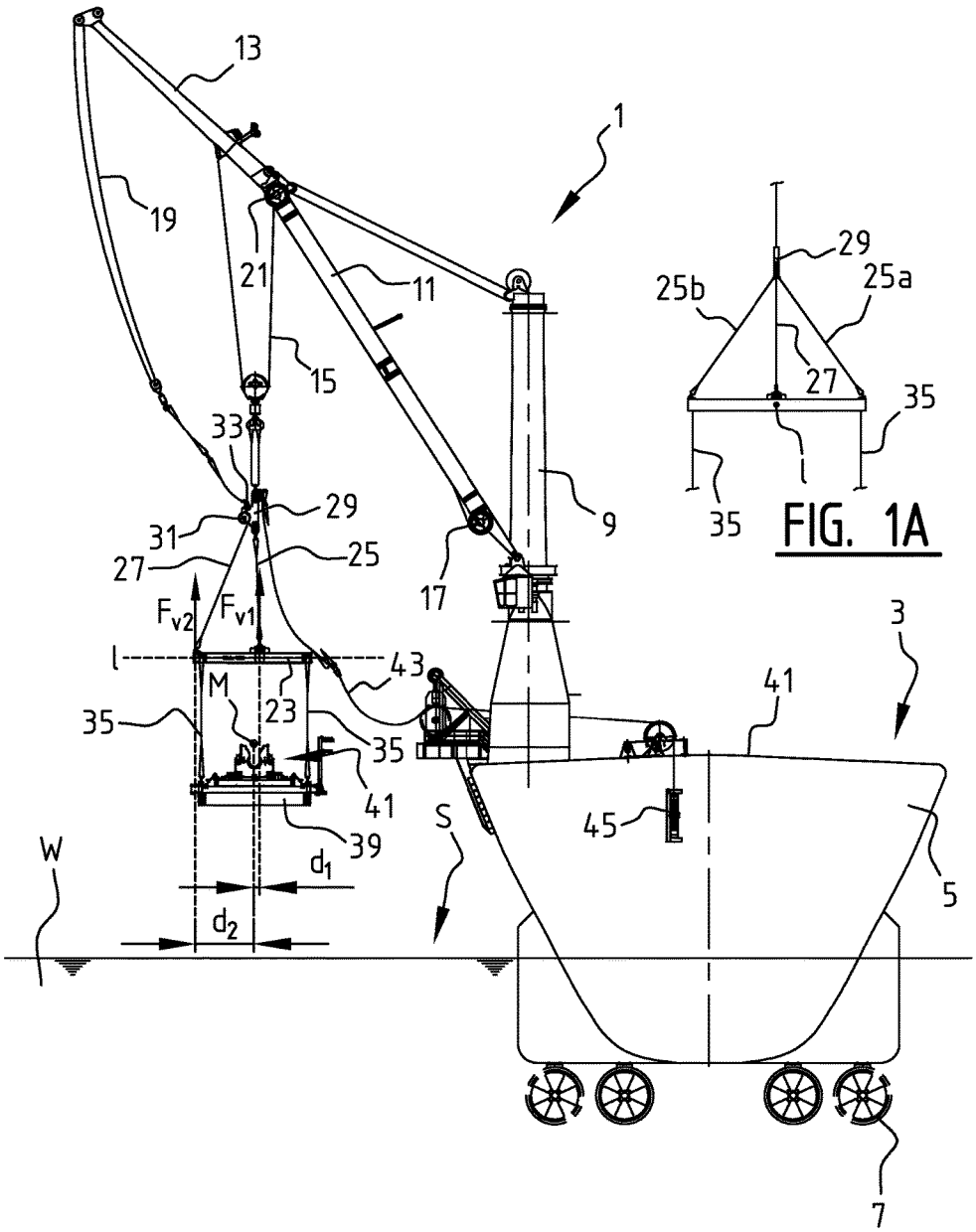

a tilted position in which the flat support base is angled with respect to the horizontal plane; lowering the subsea structure into the water through the splash zone in the tilted position; and tilting the subsea structure while suspended in the water below the splash zone back into the horizontal position.

17 Claims, 4 Drawing Sheets

(51) Int. Cl.
*B66C 23/52* (2006.01)
*B63B 27/10* (2006.01)
*E02D 29/09* (2006.01)

(58) Field of Classification Search
CPC .. F17C 2203/0607; E02B 17/00; E02B 17/02; E02B 2017/0039; E02B 2017/0073; E02B 2017/0095; B63B 21/24; B63B 21/50; B63B 21/502; E02D 27/525; E21B 19/004
USPC ..... 405/195.1, 203, 224, 352; 166/359, 367, 166/355; 114/258, 317, 331, 333, 50; 212/273, 308, 318; 254/277, 392, 900; 294/68.3, 81.1; 37/310
See application file for complete search history.

(56) References Cited

U.S. PATENT DOCUMENTS 6,457,908 B1 * 10/2002 Bergeron ..... B63B 21/04 114/230.1
6,550,411 B1 * 4/2003 Den Hartogh ..... B63B 35/003 114/258
6,685,396 B1 * 2/2004 Bergeron ..... B63B 21/04 114/296
6,991,274 B2 * 1/2006 Brooks ..... B66C 1/12 220/1.5
7,311,469 B2 * 12/2007 Pollack ..... B63B 27/10 405/191
8,056,492 B2 * 11/2011 Roodenburg ..... B63B 23/34 114/268
8,087,464 B2 * 1/2012 Rodrigues ..... B63B 27/36 166/339
8,911,178 B2 * 12/2014 Vanderbeke ..... E02B 17/027 405/209
9,387,911 B2 * 7/2016 Jamieson ..... B63G 8/001
2004/0094082 A1 * 5/2004 Boatman ..... B63B 21/50 114/249
2005/0207849 A1 * 9/2005 Roodenburg ..... E21B 19/09 405/166
2011/0258829 A1 * 10/2011 Vanderbeke ..... E02B 17/027 29/428
2012/0243945 A1 * 9/2012 Swingler ..... E02D 7/10 405/225
2015/0086299 A1 * 3/2015 Jamieson ..... B63G 8/001 414/139.6
2015/0219067 A1 * 8/2015 Clymans ..... E02B 17/0004 29/889.2

FOREIGN PATENT DOCUMENTS

GB 2076748 A 12/1981
WO WO 2009005359 A1 * 1/2009 ..... B63B 27/10
WO WO-2009005359 A1 1/2009
WO WO-2011034422 A2 3/2011
WO WO-2014031004 A1 2/2014

OTHER PUBLICATIONS

"International Application No. PCT/NL2015/050201, International Search Report dated Mar. 7, 2015", (dated Mar. 7, 2015), 4 pgs.
"International Application No. PCT/NL2015/050201, Written Opinion dated Mar. 7, 2015", (dated Mar. 7, 2015), 5 pgs.

* cited by examiner

METHOD FOR LOWERING A SUBSEA STRUCTURE HAVING A SUBSTANTIALLY FLAT SUPPORT BASE INTO THE WATER THROUGH THE SPLASH ZONE

PRIORITY APPLICATIONS

This application is a U.S. National Stage Filing under 35 U.S.C. 371 from International Application No. PCT/NL2015/050201, filed on 30 Mar. 2015, and published as WO2015/147647 on 1 Oct. 2015, which claims the benefit of priority of Netherlands Application No. 2012527, filed on 28 Mar. 2014; which applications and publication are incorporated herein by reference in their entirety.

The present invention relates to a method for lowering a subsea structure having a substantially flat support base into the water through the splash zone.

In offshore activities subsea equipment is installed on the seabed. For installing the subsea equipment on the seabed, the subsea equipment is first transported on a ship or transport barge to the location where the subsea equipment is to be installed. Subsequently the subsea equipment is lifted from the deck of the ship or transport barge and lowered into the water through the water line, the so called splash zone, towards the seabed. Once arrived at the seabed the subsea equipment is positioned on the seabed and installed. For preventing the subsea equipment to sink into the seabed, the subsea equipment is generally mounted on a relatively large flat support base, which generally includes one or more so-called mudmats. Also during transport of the subsea equipment, the subsea equipment is generally supported stable on the deck of the ship or transport barge on the flat support base.

The present invention has as one of its objects to improve the lowering of a subsea structure to be installed on the seabed into the water through the splash zone, wherein said subsea structure comprises subsea equipment arranged on a substantially flat support base for preventing the subsea equipment to sink into the seabed.

Thereto, the present invention provides a method for lowering a subsea structure having a substantially flat support base, in particular a flat support base frame or flat support base element, into the water through the splash zone, comprising:

- lifting the subsea structure into the air in a horizontal position in which the flat support base extends substantially parallel to the horizontal plane;
- tilting the subsea structure while suspended in the air from the horizontal position into a tilted position in which the flat support base is angled with respect to the horizontal plane;
- lowering the subsea structure into the water through the splash zone in the tilted position; and
- tilting the subsea structure while suspended in the water below the splash zone back into the horizontal position.

By the first step of lifting the subsea structure into the air in a horizontal position in which the flat support base extends substantially parallel to the horizontal plane, the lifting of the subsea structure of the deck of a ship or transport barge on which the subsea structure was supported during transport is uncomplicated. The latter in particular in view of the fact that the subsea structure is for stable support during transport positioned with its flat support base on the deck and is consequently already in its horizontal position. Once in the air there is sufficient free space for safely tilting the subsea structure in the air from the horizontal position into a tilted position in which the flat support base is angled with respect to the horizontal plane. The subsequent step of lowering the subsea structure into the water through the splash zone in the tilted position is advantageous in view of the loads on the subsea structure and the hoisting equipment during the lowering of the subsea structure through the splash zone. The overall load applied on the hoisting equipment and the subsea structure suspended therefrom change dramatically when the subsea structure starts touching water, up to the point where it is completely submerged. In particular contact with the waves creates widely fluctuating dynamic forces on the subsea structure and on the hoisting equipment. If the subsea structure would be lowered into the splash zone in the horizontal position thereof, the full area of the flat support base of the subsea structure would come into contact with the water at the moment the support base comes into contact with the water, resulting in relatively large change in loads applied on the hoisting equipment and the subsea structure suspended therefrom. This change of loads can severely damage the subsea structure and the hoisting equipment. By lowering according to the invention the subsea structure into the water through the splash zone in the tilted position, the full area of the flat support base of the subsea structure no longer comes into contact with the water at the moment the support base comes into contact with the water. The latter has the advantage that the change in loads applied on the hoisting equipment and the subsea structure suspended therefrom resulting from lowering the subsea structure through the splash zone is reduced. Once the subsea structure is fully submerged, and thus has passed the splash zone, there is sufficient free space to safely tilt the subsea structure back to its horizontal position, in which position the flat support base will be positioned and installed on the seabed.

The above described sequence of step of the method according to the invention provides for uncompleted movements of the subsea structure at the deck of ship or transport barge and at the seabed where free space is limited, while the more complicated movement of the tilting of the subsea structure is performed in the air and in the water where free space is available in abundance, such that damage to the subsea structure and surrounding equipment and people is prevented.

The method according to the invention thus prevents damage to the subsea structure and hoisting equipment as a result of the change in loads on the subsea structure and the hoisting equipment by lowering the subsea structure through the splash zone in tilted position, while also preventing damage to the subsea structure and surrounding equipment that might occur as a result of tilting the subsea structure before and after lowering the subsea structure trough the splash zone. The prevention of damage to the subsea structure, to the hoisting equipment, and to surrounding equipment allows for extension of the limits for wave height, wind speeds etc. within which the lifting of the subsea structure of the ship or transport barge, the tilting of the subsea structure, and the lowering of the subsea structure through the splash zone can safely be performed. For the operation of installing subsea equipment on the seabed this makes it possible to operate within larger weather windows and thus avoid delay as a result of worsened weather conditions.

In an advantageous embodiment of the method according to the invention the tilting of the subsea structure in the air is performed above the splash zone. Although alternatively the tilting of the subsea structure in the air could be performed above the ship or transport barge on which the subsea structure was transported, tilting the subsea structure in the air above the splash zone has the advantage of further preventing damage to the ship or transport barge as a result of the tilting of the subsea structure.

In an advantageous embodiment of the method according to the invention, for lifting the subsea structure, the subsea structure is suspended from a substantially flat lifting frame extending substantially parallel to the flat base of the subsea structure, wherein the lifting frame is suspended from at least one first hoisting cable and at least one second hoisting cable, each connected to the lifting frame such that with the subsea structure in the horizontal position, the vertical component of the respective lifting forces exerted by the first hoisting cable and the second hoisting cable on the lifting frame are offset from the combined center of mass of the lifting frame and the subsea structure on opposite sides of the said combined center of mass, and for tilting the subsea structure one of the first hoisting cable and second hoisting cable is drawn in or payed out.

The thus provided first and second hoisting cables allow for a controlled tilting of the lifting frame and the subsea structure suspended therefrom by simply drawing in or paying out the second hoisting cable while the lifting frame and the subsea structure are suspended in the air or in the water. By suspending the subsea structure from a lifting frame extending parallel to the support base of the subsea structure while suspending the lifting from the first and second hoisting cables, a free space between the arrangement of first and second hoisting cables and the subsea structure is provided in which the equipment of the subsea structure that is arranged on the support base can freely move when tilting the subsea structure. Preferably, in the tilted position, the lifting frame is suspended from the first hoisting cable and the second hoisting cable, wherein the vertical component of the respective lifting forces exerted by the first hoisting cable and the second hoisting cable on the lifting frame are offset from the combined center of mass of the lifting frame and the subsea structure on opposite sides of the said combined center of mass. This ensures that the subsea structure can be tilted back into the horizontal position by drawing in or paying out one of the first hoisting cable and second hoisting cable.

In an alternative embodiment, for lifting the subsea structure, the subsea structure is suspended from a first hoisting cable and a second hoisting cable, each connected to the subsea structure such that with the subsea structure in the horizontal position, the vertical component of the respective lifting forces exerted by the first hoisting cable and the second hoisting cable on the lifting frame are offset from the center of mass of the subsea structure on opposite sides of the said center of mass, and for tilting the subsea structure one of the first hoisting cable and second hoisting cable is drawn in or payed out. This alternative embodiment, wherein the lifting frame is omitted and the first and second hoisting cables are directly connected to the subsea structure, is in particular advantageous in case the shape and size of the equipment of the subsea structure arranged on the support base does not interfere with the hoisting cable arrangement when tilting the subsea structure. Preferably, in the tilted position, the lifting frame is suspended from the first hoisting cable and the second hoisting cable, wherein the vertical component of the respective lifting forces exerted by the first hoisting cable and the second hoisting cable on the lifting frame are offset from the combined center of mass of the lifting frame and the subsea structure on opposite sides of the said combined center of mass. This ensures that the subsea structure can be tilted back into the horizontal position by drawing in or paying out one of the first hoisting cable and second hoisting cable.

In an advantageous embodiment of the method according to the invention as described herein above with first and second hoisting cables, with the subsea structure in the horizontal position, the vertical component of the lifting force exerted by the first hoisting cable is offset from said center of mass by a first distance, and the vertical component of the lifting force exerted by the second hoisting cable is offset from said center of mass by a second distance, wherein the first distance is smaller than the second distance.

In this embodiment the first hoisting cable supports more weight than the second hosting cable. By applying the features of this embodiment the force that is required to be applied on the second hoisting cable for paying out or drawing in the second hoisting cable for tilting the subsea structure can thus be lower, such that the force for tilting the subsea structure can be lower.

In a further advantageous embodiment of the method according to the invention, the second hoisting cable is drawn in for tilting the subsea structure from its horizontal position into its tilted position and is payed out for tilting the subsea structure from its tilted position back into its horizontal position.

In a further advantageous embodiment of the method according to the invention with first and a second hoisting cables:

the first hoisting cable is suspended from a hoisting block;

the second hoisting cable is led through the hoisting block; and a stop is arranged on the second hoisting cable on the side of the pulley away from the lifting frame;

wherein in the horizontal position of the subsea structure, the stop is in contact with the hoisting block.

By applying the features of this embodiment, gravity pulls the stop against the hoisting block when the subsea structure is in its horizontal position. Consequently, the horizontal position of the subsea structure is maintained when no lifting force is applied to the second hoisting cable at the side of the stop away from the hoisting block. This has the advantage that during the lifting of the subsea structure from the deck of the ship or transport barge in its horizontal position and during the lowering of the subsea structure towards the seabed in its horizontal position the lifting and lowering can be performed by drawing in and paying out a single main hoisting cable from which the hoisting block is suspended. The second hoisting cable can remain slack on the side of the stop away from the subsea structure, and no precise coordination of the winch operating the main hoisting cable and the winch operating the second hoisting cable is required for maintaining the horizontal position of the subsea structure.

The present invention further relates to a system for lowering a subsea structure having a substantially flat base into the water through the splash zone, comprising lifting means for lifting the subsea structure into the air and for lowering the subsea structure into the water through the splash zone;

tilting means for tilting the subsea structure from a horizontal position in which the flat support base extends substantially parallel to the horizontal plane into a tilted position in which the flat support base is angled with respect to the horizontal plane;

wherein the lifting means and the tilting means are configured for:

lifting the subsea structure into the air in the horizontal position;

tilting the subsea structure while suspended in the air from the horizontal position into the;

lowering the subsea structure into the water through the splash zone in the tilted position; and tilting the subsea structure while suspended in the water below the splash zone back into the horizontal position.

With this system according to the invention, the embodiment of the method according to the invention as described herein above in which a lifting frame is used, can be performed with the advantage as described herein above with respect to said embodiment.

The present invention further relates to a system for lowering a subsea structure having a substantially flat base into the water through the splash zone, comprising:

a hoisting installation;

a substantially flat lifting frame suspended from the hoisting installation and configured for suspending therefrom the subsea structure;

wherein the lifting frame is suspended from the hoisting installation via a first hoisting cable and a second hoisting cable, each connected to the lifting frame such that with the lifting frame in a horizontal position in which the lifting frame extends substantially parallel to the horizontal plane, the vertical component of the respective lifting forces exerted by the first hoisting cable and the second hoisting cable on the lifting frame are offset from the center of mass of the lifting frame on opposite sides of said center of mass;

the hoisting installation comprises a first winch for operating the first hoisting cable and a second winch for operating the second hoisting cable independently from the first hoisting cable.

With this system according to the invention, the embodiment of the method according to the invention as described herein above in which a lifting frame is used, can be performed with the advantage as described herein above with respect to said embodiment.

In an advantageous embodiment of the system according to the invention the first hoisting cable is offset from the center of mass of the lifting frame by a first distance, and the second hoisting cable is offset from the center of mass of the lifting frame by a second distance, wherein the first distance is smaller than the second distance.

With this embodiment of the system according to the invention, the embodiment of the method according to the invention as described herein above in which the first hoisting cable has a smaller offset distance and the second hoisting cable, can be performed with the advantage as described herein above with respect to said embodiment.

In a further advantageous embodiment of the system according to the invention, the first hoisting cable is suspended from a hoisting block, the second hoisting cable is led through the hoisting block, and a stop is arranged on the second hoisting cable on the side of the hoisting block away from the lifting frame, wherein in the horizontal position of the lifting frame, the stop is in contact with the hoisting block.

With this embodiment of the system according to the invention, the embodiment of the method according to the invention as described herein above in which the first hoisting cable has a smaller offset distance and the second hoisting cable, can be performed with the advantage as described herein above with respect to said embodiment.

In a further embodiment of the system according to the invention the hoisting installation is arranged on a ship or offshore platform.

The present invention further relates to a set, comprising a subsea structure having a substantially flat support base, and a substantially flat lifting frame, wherein:

the subsea structure is coupled to the lifting frame for suspension wherein the substantially flat support base extends parallel to the substantially flat lifting frame;

a first hoisting cable and a second hoisting cable are connected to the lifting frame for lifting the lifting frame and the subsea structure suspended therefrom;

wherein the first hoisting cable and the second hoisting cable are connected to the lifting frame such that with the subsea structure in the horizontal position in which the substantially flat support base extends parallel to the horizontal plane, the vertical component of the respective lifting forces exerted by the first hoisting cable and the second hoisting cable on the lifting frame are offset from the combined center of mass of the lifting frame and the subsea structure on opposite sides of the said combined center of mass; and wherein the second hoisting cable is independently operable from the first hoisting cable.

The present invention further relates to an assembly for lowering a subsea structure having a substantially flat support base into the water through the splash zone, comprising:

a substantially flat lifting frame which is configured for suspending therefrom the subsea structure;

a first hoisting cable and a second hoisting cable for lifting the lifting frame, each connected to the lifting frame such that with the lifting frame in a horizontal position in which the lifting frame extends substantially parallel to the horizontal plane, the vertical component of the respective lifting forces exerted by the first hoisting cable and the second hoisting cable on the lifting frame are offset from the center of mass of the lifting frame on opposite sides of said center of mass, wherein the second hoisting cable is independently operable from the first hoisting cable.

The present invention is further elucidated in the following description with reference to the accompanying schematic figures, in which:

FIGS. 1 to 4 show in side view an embodiment of a system according to the invention in four subsequent moments in time during the performance of an embodiment of the method according to the invention.

In FIGS. 1 to 4 a hoisting installation 1 is shown which is arranged on a ship 3 of which the hull 5 is shown and thrusters 7. The hoisting installation 1 has a crane 9 with a boom 11 and a jib 13. The hoisting installation 1 is provided with a main hoisting cable 15 operated by means of a main winch 17 and an auxiliary hoisting cable 19 operated by means of an auxiliary winch 21.

Suspended from the hoisting installation 1 is a substantially flat lifting frame 23. The lifting frame 23 is suspended from the hoisting installation 1 via a first hoisting cable 25 and a second hoisting cable 27. The first hoisting cable 25 is connected at one end to the lifting frame 23 and at an opposite end to a hoisting block 29 that, in turn, is connected to the main hoisting cable 15. The lifting frame 23 extends in a plane perpendicular to the drawing plane of FIG. 1. In order to prevent the tilting of the lifting frame 23 about the line 1 where the horizontal plane in which the lifting frame extends intersects the plane of the drawing, the first hoisting cable 25 is split into two cables 25*a*, 25*b*. This is shown in FIG. 1A in which the lifting frame 23 is shown in side view in a vertical plane perpendicular to the drawing plane of FIG. 1. The second hoisting cable 27 is at one end to the lifting frame 23 and led through the hoisting block 29 over a pulley 31 provided in the hoisting block 29. A stop 33 is arranged on the second hoisting cable 15 on the side of the hoisting block 29 away from the lifting frame 23.

Suspended from the lifting frame 23 by means of cables 35 is a subsea structure 37 that is to be installed on the seabed. The subsea structure 37 has a substantially flat support base 39 and subsea equipment 41 arranged thereon. The cables 35 are arranged such that the flat support base 39 of the subsea structure 37 is suspended parallel to the lifting frame 23. In particular the lifting frame 23, the support base 39 and the cables 35 are arranged in a parallelogram configuration. For connecting the cables 35 the subsea structure 37 and the lifting frame 23 are provided with pad eyes at corners of the lifting frame and the support base.

In FIG. 1 the subsea structure 37 is suspended in its horizontal position in which the flat support base 39 extends substantially parallel to the horizontal plane. The horizontal plane extends perpendicular to the plane of the drawing. The first hoisting cable 25 is connected to the lifting frame 23 such that with the subsea structure 37 in the shown horizontal position, the vertical component $F_{v1}$ of the lifting force exerted by the first hoisting cable 25 is offset from the combined center of mass M of the lifting frame 23 and the subsea structure 37 by a first offset distance $d_1$. The second hoisting cable 27 is connected to the lifting frame 23 such that with the subsea structure 37 in the shown horizontal position, the vertical component $F_{v2}$ of the lifting force exerted by the second hoisting cable 27 is offset from the combined center of mass M of the lifting frame 23 and the subsea structure 37 by a second offset distance $d_2$. The first offset distance $d_1$ is smaller than the second offset distance $d_2$. As a result of gravity, the stop 33 is pulled against the hoisting block 29. The auxiliary hoisting cable 19 is slack, such that all weight is supported by the main hoisting cable 17.

In FIG. 1 the subsea structure 37 has been lifted of the deck 41 of the ship 3, where it was positioned on its support base 37 in its horizontal position during its transport to the location where it is to be installed, and has been lifted in the air above the splash zone S.

Figure 2:
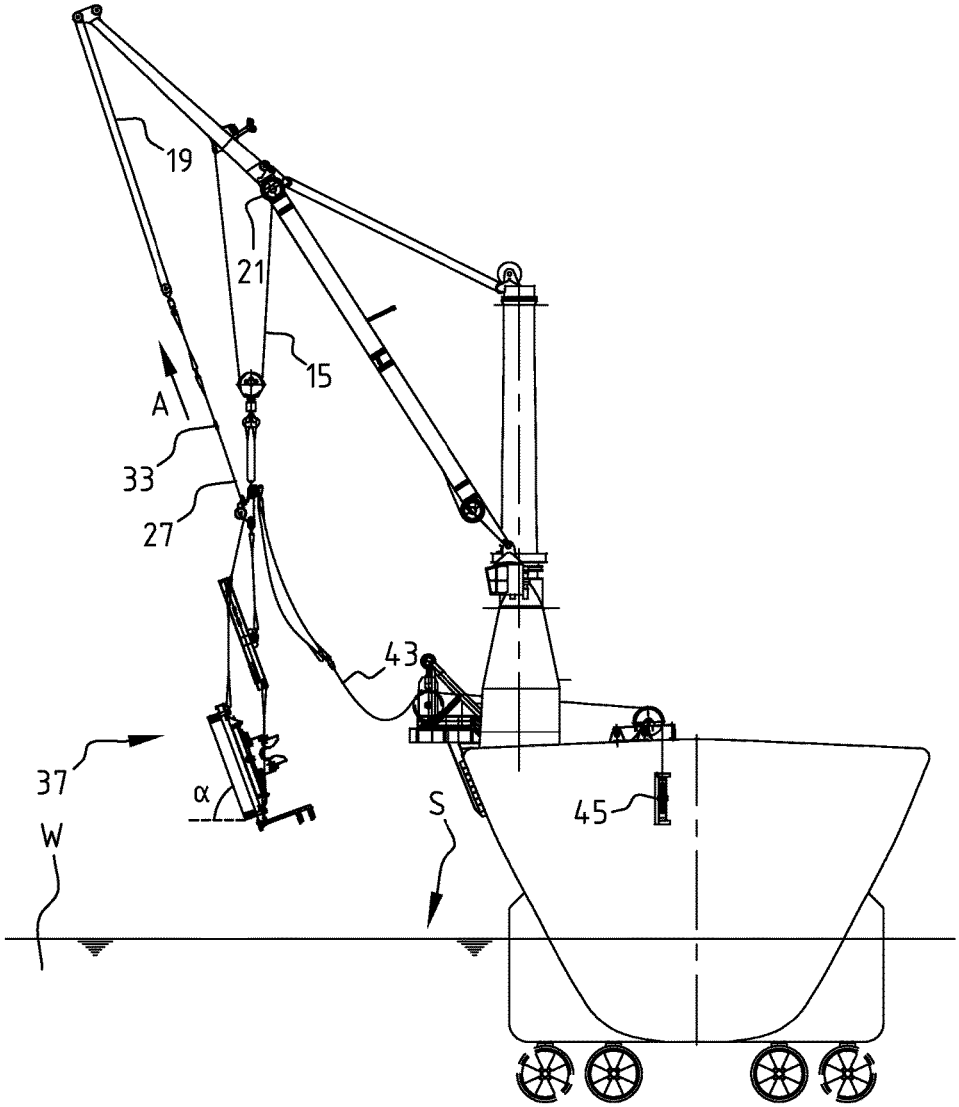

In FIG. 2 is shown that, from the situation shown in FIG. 2, by drawing in the second hoisting cable 27 by pulling the second hoisting cable 27 in direction of arrow A by means of auxiliary hoisting cable 19 and auxiliary winch 21, the subsea structure 37 has been tilted while suspended in the air from the horizontal position (shown in FIG. 1) into a tilted position (shown in FIG. 2) in which the flat support base 39 is angled $\alpha$ with respect to the horizontal plane. During the tilting of the subsea structure 37, the main hoisting cable 15 has remained stationary.

Figure 3:
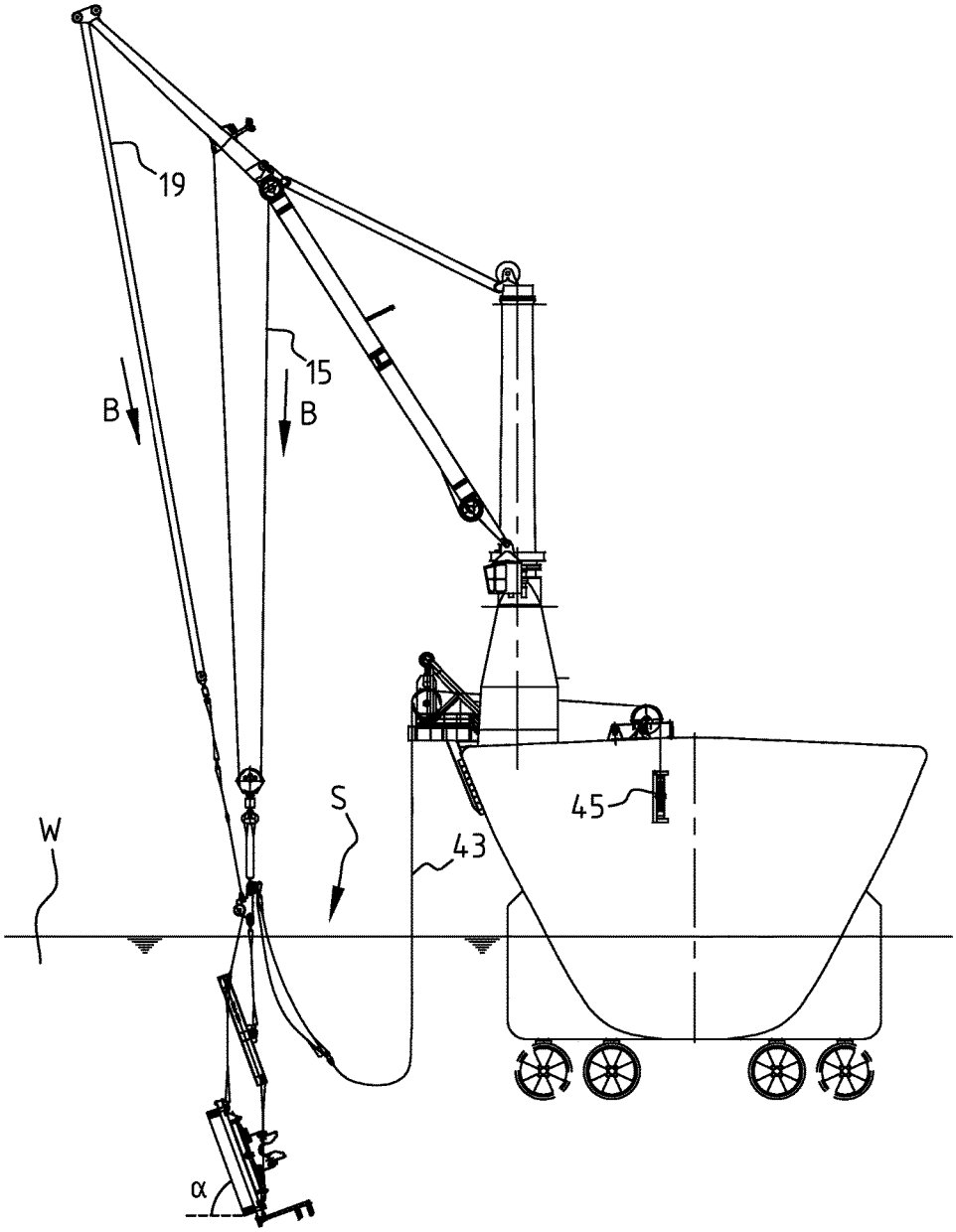

In FIG. 3 is shown that from the situation shown in FIG. 2 the subsea structure 37 has been lowered into the water W through the splash zone S in the tilted position by paying out both main hoisting cable 17 and auxiliary hoisting cable 19 in the direction of arrows B. As shown in FIG. 3 the subsea structure 37 has been lowered in its tilted position into a location in the water below the splash zone S.

Figure 4:
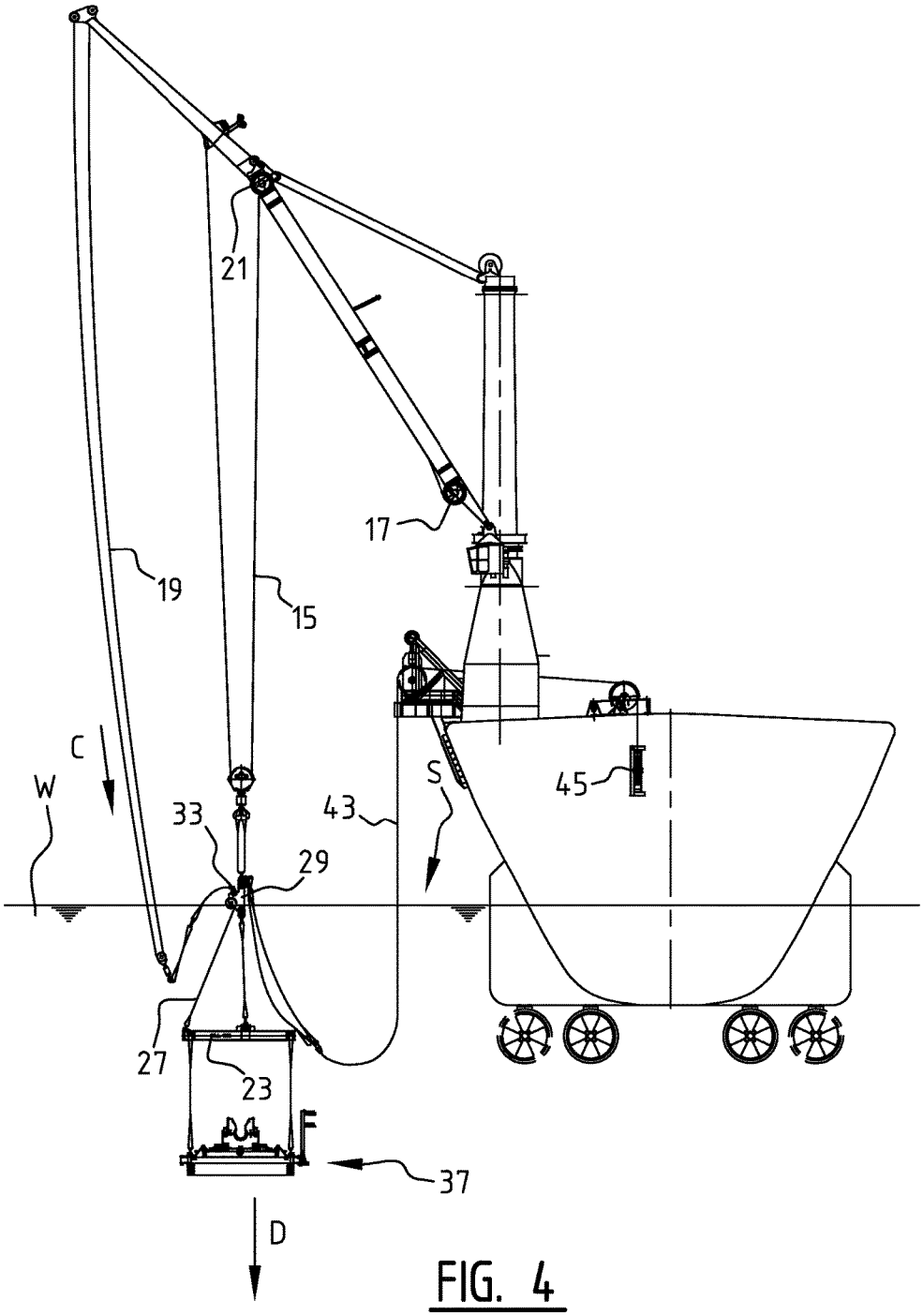

In FIG. 4 is shown that, from the situation shown in FIG. 3, by paying out the second hoisting cable 27, in particular by paying out auxiliary hoisting cable 19 in the direction of arrow C while remaining the main hoisting cable 15 stationary, the subsea structure 37 has been tilted while suspended in the water W below the splash zone S back from its tilted position (shown in FIG. 3) back into its horizontal position (shown in FIG. 4). In FIG. 4 the auxiliary hoisting cable 19 is slack, such that the subsea structure 37 is fully supported by the main hoisting cable 15.

From the situation shown in FIG. 4 the subsea structure 37 is further lowered towards the seabed in the direction of arrow D by paying out the main hoisting cable 15 and the auxiliary hoisting cable 19 by means of main winch 17 and auxiliary winch 21. Since the distance to the seabed can be large, for instance more than 1000 meters, a long range hoisting cable 43 coupled to the hoisting block 29 and a long range winch 45 are provided that take over the lowering of the subsea structure 37 and lifting frame 23 towards the seabed after decoupling of the main hoisting cable 15 from the hoisting block 29 and decoupling of the auxiliary hoisting cable 19 from the second hoisting cable 25. As a result of gravity the stop 33 is pulled against the hoisting block 29, such that the subsea structure 37 remains in its horizontal position even though no hoisting cable is connected to the end of the second hoisting cable 25 away from the lifting frame 23. In more shallow water, the main hoisting cable 15 can be used to lower the subsea structure 37 all the way to the seabed.

The subsea structure 37 is lowered to the seabed in its horizontal position, where it is installed on the seabed.

While the principles of the invention have been set out above in connection with specific embodiments, it is to be understood that this description is merely made by way of example and not as a limitation of the scope of protection, which is determined by the appended claims.

The invention claimed is:

1. A method for lowering from the hull of a ship a subsea structure to be installed on the seabed into the water through the splash zone, said subsea structure comprising subsea equipment arranged on a substantially flat support base for preventing the subsea equipment to sink into the seabed, the method comprising:

lifting the subsea structure into the air in a horizontal position in which the flat support base extends substantially parallel to the horizontal plane;

reducing the area of the flat support base of the subsea structure that comes into contact with the water at the moment the support base comes into contact with the water by tilting the subsea structure while suspended in the air from the horizontal position into a tilted position in which the flat support base is angled with respect to the horizontal plane;

lowering the subsea structure into the water through the splash zone in the tilted position at a location spaced horizontally from the hull of the ship; and tilting the subsea structure while suspended in the water below the splash zone back into the horizontal position, wherein for lifting the subsea structure, the subsea structure is suspended from a substantially flat lifting frame by a first lifting cable and a second lifting cable extending substantially parallel to the flat support base of the subsea structure, wherein the lifting frame is suspended from a first hoisting cable and a second hoisting cable, each connected to the lifting frame such that with the subsea structure in the horizontal position, the vertical component of the respective lifting forces exerted by the first hoisting cable and the second hoisting cable on the lifting frame are offset from the combined center of mass of the lifting frame and the subsea structure on opposite sides of the said combined center of mass; and for tilting the subsea structure one of the first hoisting cable and second hoisting cable is drawn in or payed out.

2. The method according to claim 1, wherein the tilting of the subsea structure in the air is performed above the splash zone and continues until the subsea structure is below the hull of the ship.

3. The method according to claim 1, wherein in the tilted position, the lifting frame is suspended from the first hoisting cable and the second hoisting cable, wherein the vertical component of the respective lifting forces exerted by the first hoisting cable and the second hoisting cable on the lifting frame are offset from the combined center of mass of the lifting frame and the subsea structure on opposite sides of the said combined center of mass.

4. The method according to claim 1, wherein for lifting the subsea structure, the subsea structure is suspended from a first hoisting cable and a second hoisting cable, each connected to the subsea structure at locations spaced horizontally from a center of mass of the subsea structure different distances such that with the subsea structure in the horizontal position, the vertical component of the respective lifting forces exerted by the first hoisting cable and the second hoisting cable on the lifting frame are offset from the center of mass of the subsea structure on opposite sides of the said center of mass; and for tilting the subsea structure one of the first hoisting cable and second hoisting cable is drawn in or payed out.

5. The method according to claim 4, wherein in the tilted position, the lifting frame is suspended from the first hoisting cable and the second hoisting cable, wherein the vertical component of the respective lifting forces exerted by the first hoisting cable and the second hoisting cable on the lifting frame are offset from the combined center of mass of the lifting frame and the subsea structure on opposite sides of the said combined center of mass.

6. The method according to claim 1, wherein, with the subsea structure in the horizontal position, the vertical component of the lifting force exerted by the first hoisting cable is offset from said center of mass by a first distance;

the vertical component of the lifting force exerted by the second hoisting cable is offset from said center of mass by a second distance, wherein the first distance is smaller than the second distance.

7. The method according to claim 1, wherein the second hoisting cable is drawn in for tilting the subsea structure from its horizontal position into its tilted position and is payed out for tilting the subsea structure from its tilted position back into its horizontal position.

8. The method according to claim 7, wherein the first hoisting cable is suspended from a hoisting block;

the second hoisting cable is led through the hoisting block; and a stop is arranged on the second hoisting cable on the side of the hoisting block away from the lifting frame;

wherein in the horizontal position of the subsea structure, the stop is in contact with the hoisting block.

9. The method according to claim 4, wherein, with the subsea structure in the horizontal position, the vertical component of the lifting force exerted by the first hoisting cable is offset from said center of mass by a first distance;

the vertical component of the lifting force exerted by the second hoisting cable is offset from said center of mass by a second distance, wherein the first distance is smaller than the second distance.

10. The method according to claim 4, wherein the second hoisting cable is drawn in for tilting the subsea structure from its horizontal position into its tilted position and is payed out for tilting the subsea structure from its tilted position back into its horizontal position.

11. The method according to claim 10, wherein the first hoisting cable is suspended from a hoisting block;

the second hoisting cable is led through the hoisting block; and a stop is arranged on the second hoisting cable on the side of the hoisting block away from the lifting frame;

wherein in the horizontal position of the subsea structure, the stop is in contact with the hoisting block.

12. A system for lowering a subsea structure to be installed on the seabed into the water through the splash zone, said subsea structure comprising subsea equipment arranged on a substantially flat support base wider than the subsea equipment for preventing the subsea equipment to sink into the seabed, comprising:

lifting means for lifting the subsea structure into the air and for lowering the subsea structure into the water through the splash zone;

tilting means for tilting the subsea structure from a horizontal position in which the flat support base extends substantially parallel to the horizontal plane into a tilted position in which the flat support base is angled with respect to the horizontal plane;

a hoisting installation; and a substantially flat lifting frame suspended from the hoisting installation and configured for suspending therefrom the subsea structure;

wherein the lifting means and the tilting means are configured for:

lifting the subsea structure into the air in the horizontal position;

reducing the area of the flat support base of the subsea structure that comes into contact with the water at the moment the support base comes into contact with the water by tilting the subsea structure while suspended in the air from the horizontal position into the tilted position;

lowering the subsea structure into the water through the splash zone in the tilted position; and tilting the subsea structure while suspended in the water below the splash zone back into the horizontal position, wherein the lifting frame is suspended from the hoisting installation via a first hoisting cable and a second hoisting cable connected to the substantially flat lifting frame, each connected to the lifting frame such that with the lifting frame in a horizontal position in which the lifting frame extends substantially parallel to the horizontal plane, the vertical component of the respective lifting forces exerted by the first hoisting cable and the second hoisting cable on the lifting frame are offset from the center of mass of the lifting frame on opposite sides of said center of mass; and the hoisting installation comprises a first winch for operating the first hoisting cable and a second winch for operating the second hoisting cable independently from the first hoisting cable.

13. The system according to claim 12, wherein the first hoisting cable is offset from the center of mass of the lifting frame by a first distance;

the second hoisting cable is offset from the center of mass of the lifting frame by a second distance, wherein the first distance is smaller than the second distance.

14. The system according to claim 12, wherein the first hoisting cable is suspended from a hoisting block;

the second hoisting cable is led through the hoisting block; and a stop is arranged on the second hoisting cable on the side of the pulley away from the lifting frame;

wherein in the horizontal position of the lifting frame, the stop is in contact with the hoisting block.

15. System according to claim 12, wherein the hoisting installation is arranged on a ship or offshore platform.

16. The system according to claim 12, wherein the subsea structure is coupled to the lifting frame by a first lifting cable and a second lifting cable for suspension wherein the substantially flat support base extends parallel to the substantially flat lifting frame; and wherein the second hoisting cable is independently operable from the first hoisting cable.

17. The system according to claim 16, wherein the substantially flat lifting frame the first and second lifting cables and the substantially flat support base being arranged in a parallelogram configuration.

* * * * *